US009762988B2

(12) United States Patent
Akino

(10) Patent No.: US 9,762,988 B2
(45) Date of Patent: Sep. 12, 2017

(54) MICROPHONE

(71) Applicant: Hiroshi Akino, Kanagawa (JP)

(72) Inventor: Hiroshi Akino, Kanagawa (JP)

(73) Assignee: KABUSHIKI KAISHA AUDIO-TECHNICA, Tokyo (JP)

( * ) Notice: Subject to any disclaimer, the term of this patent is extended or adjusted under 35 U.S.C. 154(b) by 0 days.

(21) Appl. No.: 15/078,106

(22) Filed: Mar. 23, 2016

(65) Prior Publication Data

US 2016/0286292 A1 Sep. 29, 2016

(30) Foreign Application Priority Data

Mar. 24, 2015 (JP) ..... 2015-060514

(51) Int. Cl.

| | |
|---|---|
| ***H04R 1/08*** | (2006.01) |
| ***H04R 9/08*** | (2006.01) |
| ***H04R 1/04*** | (2006.01) |
| *H04R 1/06* | (2006.01) |

(52) U.S. Cl.

CPC *H04R 1/04* (2013.01); *H04R 1/06* (2013.01)

(58) Field of Classification Search

CPC ..... H04R 1/08; H04R 9/08; H04R 11/04; H04R 17/02; H04R 21/02; H04R 1/086

USPC ..... 381/355–356, 359–362, 369

See application file for complete search history.

(56) References Cited

U.S. PATENT DOCUMENTS

| | | | | |
|---|---|---|---|---|
| 4,410,770 | A * | 10/1983 | Hagey | H04R 1/38 381/355 |
| 4,910,795 | A * | 3/1990 | McCowen | H04R 1/083 381/355 |
| 5,701,355 | A * | 12/1997 | Brannan | H04R 1/08 381/355 |
| 5,898,789 | A * | 4/1999 | Nichols | H01R 13/506 381/355 |
| 7,889,882 | B2 * | 2/2011 | Marshall | H04R 19/04 381/355 |

FOREIGN PATENT DOCUMENTS

JP 4683996 B2 5/2011

* cited by examiner

*Primary Examiner* — Suhan Ni

(74) *Attorney, Agent, or Firm* — Whitham, Curtis, & Cook, P.C.

(57) ABSTRACT

A microphone is provided that ensures the electrical connection between a unit case and an audio-signal output circuit board. The microphone includes a unit case 10 having a shape of a hollow cylinder with a closed end and accommodating an electroacoustic transducer 20, an audio-signal output circuit board 40 connected to the electroacoustic transducer, and a microphone case accommodating the unit case and the audio-signal output circuit board, wherein the audio-signal output circuit board has a receiver 41 disposed on a portion of the peripheral edge of the audio-signal output circuit board, and an open end 11 of the unit case comes into contact with the receiver and is positioned when the unit case and the audio-signal output circuit board are accommodated in the microphone case.

11 Claims, 11 Drawing Sheets

MICROPHONE

TECHNICAL FIELD

The present invention relates to a microphone.

BACKGROUND ART

Some microphones are provided with microphone units and audio-signal output circuit boards that process signals from the respective microphone units and are disposed in the proximity of the respective microphone units, to reduce the overall dimensions of the microphones. In such a microphone, the audio-signal output circuit board is attached directly with solder, for example, to a circuit board provided with a field-effect transistor (FET) and installed in the microphone unit, to reduce the dimensions of the microphone section accommodating the microphone unit and the audio-signal output circuit board.

FIG. 9 is a cross-sectional side view illustrating a microphone unit included in a conventional microphone.

A microphone unit 1*a* includes a unit case 10*a*, an electroacoustic transducer accommodated in the unit case 10*a*, an impedance converter of the electroacoustic transducer, and a circuit board 26*a*.

The unit case 10*a* has a shape of a hollow cylinder with a closed end. The unit case 10*a* is composed of pressed metal, such as aluminum. The unit case 10*a* has an acoustic-wave entering hole 10*ah* through which acoustic waves from a sound source pass. The acoustic-wave entering hole 10*ah* is formed on the face of the unit case 10*a* opposite to an opening.

The electroacoustic transducer includes a spacer 21*a*, a diaphragm 22*a*, a fixed electrode 23*a*, a diaphragm holder 24*a*, and an insulator 25*a*.

The diaphragm 22*a* and the fixed electrode 23*a* face each other with the spacer 21*a* disposed therebetween. The diaphragm 22*a* and the fixed electrode 23*a* constitute a condenser. A layer of air having a thickness equivalent to that of the spacer 21*a* is formed between the diaphragm 22*a* and the fixed electrode 23*a*.

The diaphragm 22*a* is a thin film composed of synthetic resin with a metal (preferably gold) film deposited on one side. The diaphragm 22*a* is stretched on the diaphragm holder 24*a* with predetermined tension.

The fixed electrode 23*a* is composed of metal. The fixed electrode 23*a* has a shape of a disk. At least one of the faces of the fixed electrode 23*a*, for example, the face adjacent to the diaphragm 22*a*, has an electret plate bonded thereto. The fixed electrode 23*a* and the electret plate constitute an electret board. The fixed electrode 23*a* is fixed to the cylindrical shaped insulator 25*a* composed of synthetic resin.

The disk-shaped circuit board 26*a* covers the opening of the unit case 10*a*. The circuit board 26*a* is fixed inside the unit case 10*a* by curling of the rear edge 11*a* of the unit case 10*a*. The field-effect transistor (FET) which constitutes the impedance converter is disposed on the face facing the interior of the unit case 10*a* among the two faces of the circuit board 26*a* fixed inside the unit case 10*a*.

The FET includes a gate electrode E1, a drain electrode E2, and a source electrode E3. The gate electrode E1 is electrically connected to the fixed electrode 23*a*. The drain electrode E2 and the source electrode E3 are aligned in FIG. 9, and thus, only one of these electrodes are illustrated in FIG. 9.

The circuit board 26*a* has multiple holes 26*ah* across the thickness of the circuit board 26*a* (which is the horizontal direction in FIG. 9). The drain electrode E2 and the source electrode E3 pass through some of the holes 26*ah*. Air to be introduced to an air chamber AC disposed behind the fixed electrode 23*a* passes through the other holes 26*ah* via an acoustic resistor AR.

Solder pads (signal lands SL and ground lands GL and GL2) are disposed on the outer face facing the exterior of the unit case 10*a* of the circuit board 26*a* fixed to the unit case 10*a*. The drain electrode E2 and the source electrode E3 are attached to the solder pads with solder. A microphone cable (not shown) is connected to the solder pads. The ground land GL is connected to the rear edge 11*a* of the unit case 10*a* and the ground land GL2.

FIG. 10 is a cross-sectional side view illustrating components of a conventional microphone.

An audio-signal output circuit board 40*a* includes circuits for processing electrical signals from the microphone unit 1*a*. The microphone unit 1*a* is attached to the audio-signal output circuit board 40*a* with solder, for example. The microphone unit 1*a* and the audio-signal output circuit board 40*a* are accommodated in a microphone case 70*a* covered with a cap C.

FIG. 11 is a cross-sectional side view illustrating the ground paths in a conventional microphone.

The diaphragm holder 24*a* is electrically connected to a ground pattern 43*a* disposed on the audio-signal output circuit board 40*a* via the unit case 10*a* and the ground lands GL and GL2. The straight line connecting the ground land GL2 and the ground pattern 43*a* in FIG. 11 represents the electrically connected state between the ground land GL2 and the ground pattern 43*a*. This straight line is provided for convenience of explanation of the conventional microphone.

Schemes have been proposed to connect the unit case and the ground pattern, to prevent from generating noise due to electromagnetic waves from the connection between the microphone unit and the microphone case intruding the interior of the microphone case 70*a* (for example, refer to Japanese Patent Publication No. 4683996).

SUMMARY OF INVENTION

Technical Problem

When the microphone unit 1*a* and the audio-signal output circuit board 40*a* are accommodated in the microphone case 70*a*, the microphone unit 1*a* receives stress from the audio-signal output circuit board 40*a*. Thus, the components placed inside the unit case 10*a*, such as the circuit board 26*a* of the microphone unit 1*a* , are pushed forward (left in FIG. 10) along the axial direction of the microphone. As a result, the connection between the rear edge 11*a* of the unit case 10*a* and the ground land GL become disconnected or unstable, as indicated by the circles in FIG. 10.

When the connection between the rear edge 11*a* of the unit case 10*a* and the ground land GL are released, the electrical connection between the unit case 10*a* and the ground pattern 43*a* is disconnected. In this case, the microphone may generate noise and the components accommodated inside the microphone unit 1 may be damaged.

An object of the present invention, which has been made to solve the problem described above, is to provide a microphone that can certainly establish an electrical connection between a unit case and an audio-signal output circuit board.

Solution to Problem

The microphone according to the present invention includes a unit case having a shape of a hollow cylinder with a closed end and accommodating an electroacoustic transducer; an audio-signal output circuit board having a shape of a plate and connecting to the electroacoustic transducer; and a microphone case accommodating the unit case and the audio-signal output circuit board, wherein the audio-signal output circuit board has a receiver disposed on a portion of the peripheral edge of the audio-signal output circuit board, and an open end of the unit case comes into contact with the receiver and is positioned when the unit case and the audio-signal output circuit board are accommodated in the microphone case.

According to the present invention, a certain electrical connection can be established between a unit case and an audio-signal output circuit board.

BRIEF DESCRIPTION OF DRAWINGS

FIG. 8A illustrates the unit case prior to insertion of the audio-signal output circuit board; and FIG. 8B illustrates the unit case after insertion of the audio-signal output circuit board.

DESCRIPTION OF EMBODIMENTS

Embodiments of a microphone will now be described with reference to the attached drawings.

Figure 1:
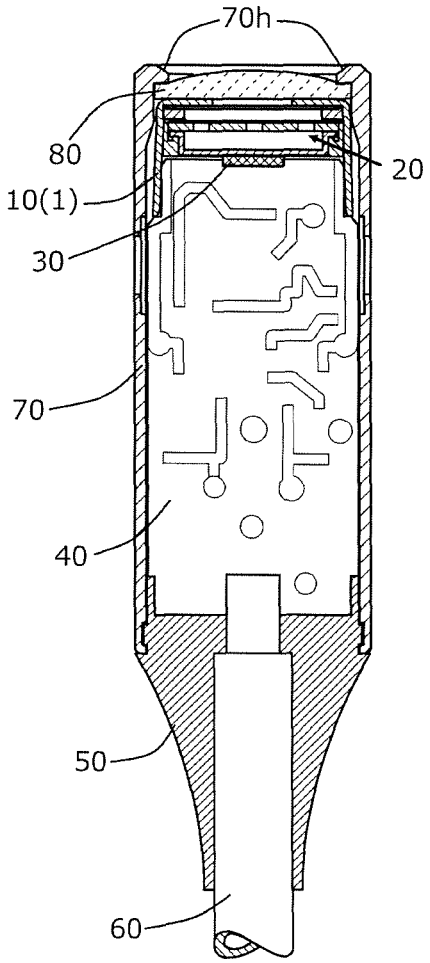
FIG. 1 is a cross-sectional side view illustrating a microphone according to an embodiment of the present invention.

FIG. 1 is a cross-sectional side view illustrating the microphone according to an embodiment of the present invention.

The microphone includes a microphone unit 1, a conductive elastic member 30, an audio-signal output circuit board 40, a rear case 50, a microphone case 70, and an elastic member 80. The microphone unit 1, the conductive elastic member 30, the audio-signal output circuit board 40, a portion of the rear case 50, and the elastic member 80 are accommodated in the microphone case 70.

As described below, the microphone unit 1 includes a unit case 10 and an electroacoustic transducer 20 accommodated in the unit case 10.

The conductive elastic member 30 is disposed between the microphone unit 1 and the audio-signal output circuit board 40. The use and operation of the conductive elastic member 30 will be described below.

The assembly process of the microphone will now be described with reference to FIGS. 2 to 5.

Figure 2:
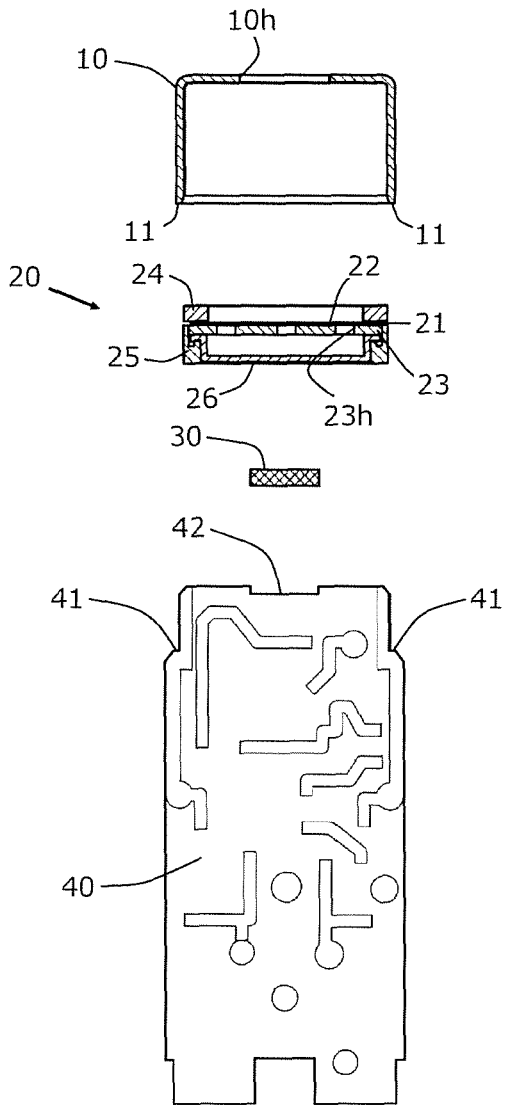
FIG. 2 is an exploded cross-sectional side view illustrating a unit case, an electroacoustic transducer, and an audio-signal output circuit board, constituting the microphone.

FIG. 2 is an exploded cross-sectional side view illustrating the unit case 10, the electroacoustic transducer 20, and the audio-signal output circuit board 40.

The unit case 10 is composed of metal. The unit case 10 has a shape of a hollow cylinder with a closed end. The unit case 10 has an acoustic-wave entering hole 10*h* through which acoustic waves from a sound source pass. The acoustic-wave entering hole 10*h* is formed on the bottom face which is located in the front face of the unit case 10 (the direction of the microphone that is directed to the sound source during sound collection) portion of the unit case 10. The rear face of the unit case 10 has the opening defined by an open end 11.

The electroacoustic transducer 20 includes a spacer 21, a diaphragm 22, a fixed electrode 23, a diaphragm holder (diaphragm ring) 24, an insulator 25, and a support 26. The electroacoustic transducer 20 is disposed inside the unit case 10.

The diaphragm 22 and the fixed electrode 23 face each other with the spacer 21 disposed therebetween. A layer of air (gap) having a thickness equivalent to that of the spacer 21 is disposed between the diaphragm 22 and the fixed electrode 23. The diaphragm 22 and the fixed electrode 23 constitute a condenser. The capacitance of the condenser varies with the vibration of the diaphragm 22 caused by acoustic waves entering the unit case 10 through the acoustic-wave entering hole 10*h*.

The spacer 21 is composed of synthetic resin, for example. The spacer 21 has a thin ring shape.

The diaphragm 22 is a thin-film composed of synthetic resin with a metal (preferably gold) film deposited on one side. The diaphragm 22 is stretched on the diaphragm holder 24 with predetermined tension.

The fixed electrode 23 is composed of metal. The fixed electrode 23 has a shape of a disk. At least one of the faces of the fixed electrode 23, for example, the face adjacent to the diaphragm 22, has an electret plate bonded thereto. The fixed electrode 23 and the electret plate constitute an electret board. The fixed electrode 23 has multiple sound holes 23*h* through which acoustic waves pass.

The insulator 25 is composed of an insulating material, such as synthetic resin. The insulator 25 has a shape of a substantial cylinder. The fixed electrode 23 is fit inside the forward portion of the insulator 25. The support 26 is fit inside the rear portion of the insulator 25. The support 26 is composed of metal. The support 26 has a shape of a hollow cylinder with a closed end. The support 26 supports the fixed electrode 23 from behind. The support 26 forms an air chamber behind the fixed electrode 23. The support 26 has a hole when the microphone unit 1 is unidirectional. The hole is formed on the bottom face of the support 26. The hole is covered with an acoustic resistor provided in the interior of the support 26. The hole is not to be formed on the support 26 when the microphone unit 1 is omnidirectional.

The audio-signal output circuit board 40 is a substantially rectangular shaped plate. The audio-signal output circuit board 40 includes a field-effect transistor (FET) of an impedance converter of the electroacoustic transducer 20 and a circuit for converting the variation in the capacitance of the capacitor to electrical signals and outputting the electrical signals.

The audio-signal output circuit board 40 includes a small-width section, a large-width section, receivers 41, and a depression 42. The receivers 41 are disposed at the boundary areas of small-width section and the large-width section of two opposite sides along the longitudinal direction of the audio-signal output circuit board 40. The small-width section refers to a portion of the audio-signal output circuit board 40 having a small length in the width direction (the section above the receivers 41 in FIG. 2). The large-width section refers to a portion of the audio-signal output circuit board 40 having a length larger than of the small length of the small-width section in the width direction (the section below the receivers 41 in FIG. 2).

The longitudinal direction of the audio-signal output circuit board 40 refers to the anteroposterior direction (vertical direction in FIG. 2) of the audio-signal output circuit board 40 orthogonal to the thickness direction of the audio-signal output circuit board 40. The width direction of the audio-signal output circuit board 40 refers to a direction orthogonal to the longitudinal direction of the audio-signal output circuit board 40 (horizontal direction in FIG. 2). The width direction of the audio-signal output circuit board 40 is a direction orthogonal to the thickness direction of the audio-signal output circuit board 40.

As described below, the receivers 41 should be disposed on a portion of the peripheral edge of the audio-signal output circuit board 40 such that the receivers 41 come into contact with the open end 11 of the unit case 10, to position the unit case 10 inside the microphone. For example, the receivers 41 may be disposed on at least one of two opposite sides along the longitudinal direction (anteroposterior direction) of the audio-signal output circuit board 40.

The depression 42 is disposed on a front portion (at the top of FIG. 2) of the peripheral edge of the audio-signal output circuit board 40.

Figure 3:
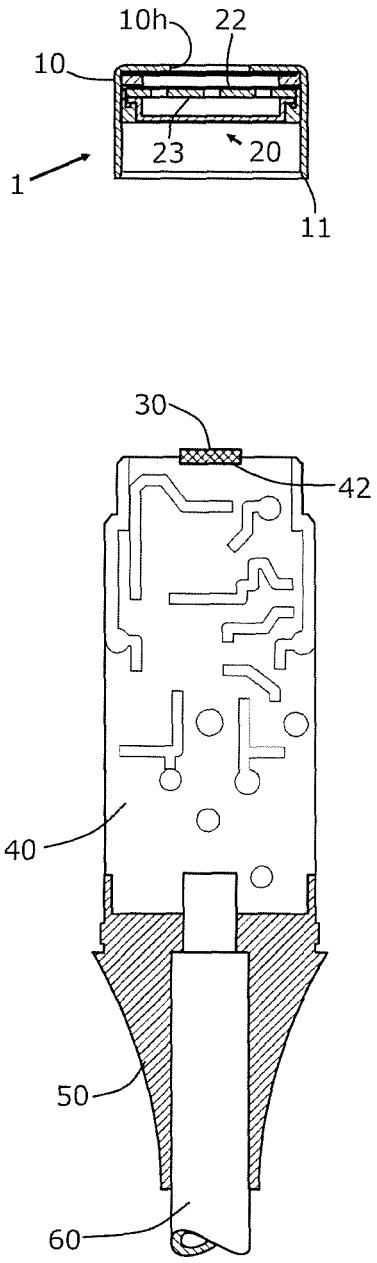
FIG. 3 is an exploded cross-sectional side view illustrating a microphone unit, an audio-signal output circuit board, and a rear case, constituting the microphone.

FIG. 3 is an exploded cross-sectional side view illustrating the microphone unit 1, the audio-signal output circuit board 40, and the rear case 50.

The microphone unit 1 includes the unit case 10 and the electroacoustic transducer 20. The electroacoustic transducer 20 is disposed inside the unit case 10 such that the diaphragm 22 is disposed adjacent to the acoustic-wave entering hole 10*h* in the unit case 10 and the fixed electrode 23 adjacent to the open end 11 of the unit case 10.

The conductive elastic member 30 is placed in the depression 42 of the audio-signal output circuit board 40.

The rear case 50 is composed of metal. The rear case 50 has a shape of a substantial cylinder. The rear case 50 has a groove that fits together with a rear portion (at the bottom of FIG. 3) of the audio-signal output circuit board 40. The rear portion of the audio-signal output circuit board 40 is fit into the groove in the rear case 50. The audio-signal output circuit board 40 is electrically connected and fixed to the rear case 50.

The audio-signal output circuit board 40 is electrically connected to a connector (not shown) via a microphone cable 60 passing through the inside of the rear case 50. The connector is, for example, an output connector including a pin 1 for ground, a pin 2 for hot signals, and a pin 3 for cold signals, and conforms to JEITA Standard RC-5236 "Circular Connectors, Latch Lock Type for Audio Equipment."

Figure 4:
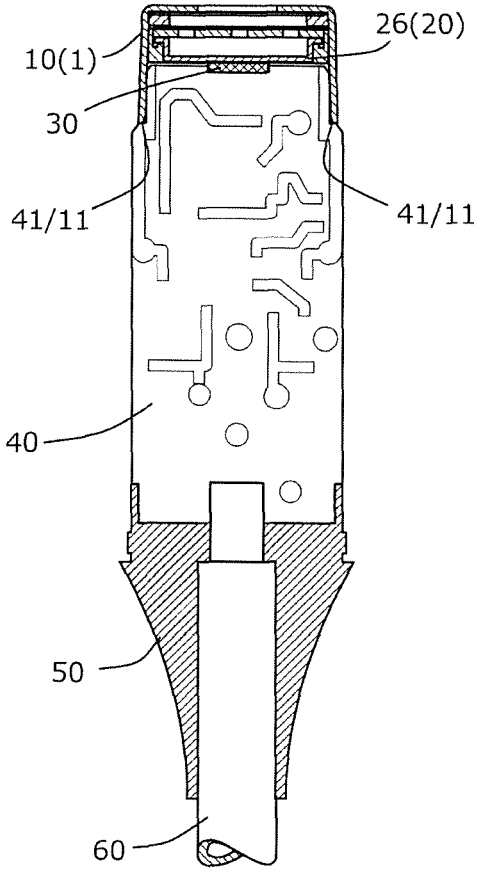
FIG. 4 is a cross-sectional side view illustrating the microphone unit and the audio-signal output circuit board.

FIG. 4 is a cross-sectional side view illustrating the microphone unit 1 and the audio-signal output circuit board 40.

The small-width section of the audio-signal output circuit board 40 is inserted inside the unit case 10 through the opening in the unit case 10. The small-width section is fit into the open end 11 of the unit case 10. When the receivers 41 of the audio-signal output circuit board 40 contacts to the open end 11 of the unit case 10, then the audio-signal output circuit board 40 is prevented from moving further inside the unit case 10.

The conductive elastic member 30 is disposed between the support 26 of the electroacoustic transducer 20 disposed inside the unit case 10 and the audio-signal output circuit board 40. When the audio-signal output circuit board 40 is inserted into the unit case 10, then the stress generated from the audio-signal output circuit board 40 is transmitted to the electroacoustic transducer 20 inside the unit case 10 via the conductive elastic member 30. Some of the stress is absorbed by the elasticity of the conductive elastic member 30. That is, the conductive elastic member 30 functions as a buffer between the electroacoustic transducer 20 and the audio-signal output circuit board 40.

Tests for sensitivity of the microphone unit 1 (line measurement), for example, can be conducted during a connected state of the microphone unit 1, the audio-signal output circuit board 40, the rear case 50, and the microphone cable 60, as illustrated in FIG. 4. If the tests reveal a defect in the microphone unit 1, the microphone unit 1 should be replaced and the tests should be conducted again. The tests for the microphone unit 1 can be conducted before the microphone unit 1 is accommodated in the microphone case 70, which is described below. Thus, the microphone unit 1 can be readily replaced depending on the test results.

Figure 5:
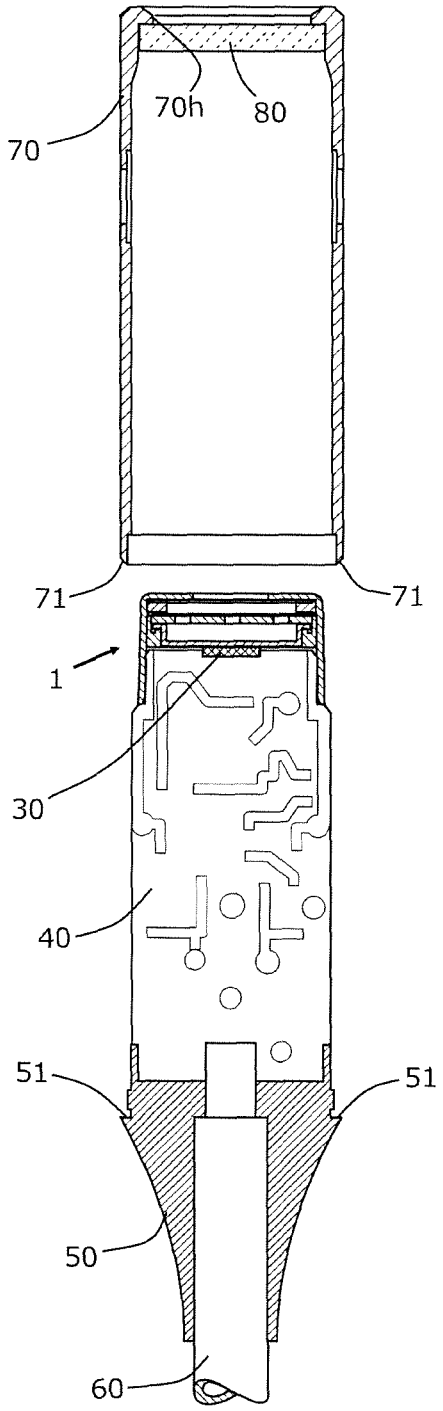
FIG. 5 is an exploded cross-sectional side view illustrating a microphone case, the microphone unit, and the audio-signal output circuit board, constituting the microphone.

FIG. 5 is an exploded cross-sectional side view illustrating the microphone unit 1, the audio-signal output circuit board 40, and the microphone case 70.

The microphone case 70 is composed of metal. The microphone case 70 has a shape of a hollow cylinder with a closed end. The microphone case 70 accommodates the microphone unit 1, the audio-signal output circuit board 40, and a portion of the rear case 50. The microphone case 70 has an acoustic-wave entering hole 70*h*. The acoustic-wave entering hole 70*h* is formed in the bottom face of the microphone case 70.

Figure 10:
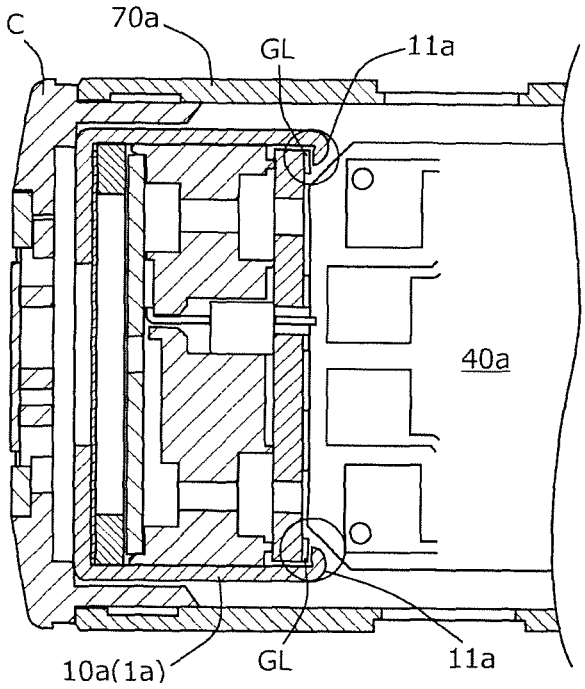
RELATED ART FIG. 10
FIG. 10 is a cross-sectional side view illustrating components of a conventional microphone.
Figure 11:
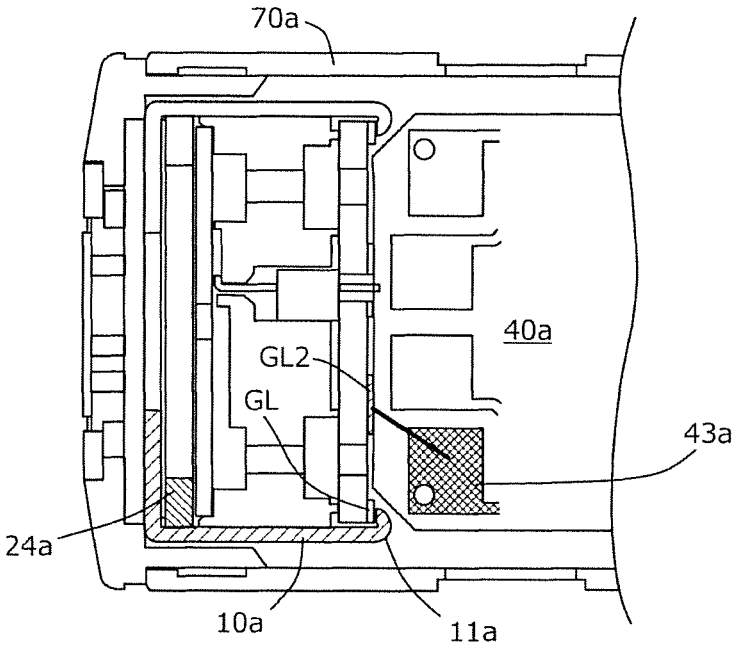
RELATED ART FIG. 11
FIG. 11 is a cross-sectional side view illustrating a ground paths of a conventional microphone.

The shape of the microphone case should not be limited to a hollow cylinder with a closed end. For example, the shape of the microphone may be a cylinder such as that of the microphone case 70*a* of the conventional microphone illustrated in FIG. 10. For a cylindrical shaped microphone case, a cap covers one of the two openings in the microphone case. The cap has a shape of a hollow cylinder with a closed end. The cap has an acoustic-wave entering hole in the bottom face.

The elastic member 80 is disposed inside the microphone case 70 on the bottom face. The acoustic waves pass through the acoustic-wave entering hole (sound hole) 70*h* in the microphone case 70 and the elastic member 80, and enter the microphone case 70.

The microphone unit 1, the audio-signal output circuit board 40, and a portion of the rear case 50 are inserted to the microphone case 70 through the opening of the microphone case 70. The microphone case 70 is fixed with screws to the rear case 50 with the open end 71 of the microphone case 70 in contact with receivers 51 on the outer circumferential surface of the rear case 50. As a result, the microphone enters the state illustrated in FIG. 1. The unit case 10 is located in the position facing the acoustic-wave entering hole 70*h* inside the microphone case 70. With reference FIG. 1, the elastic member 80 is disposed between the acoustic-wave entering hole 70*h* and the unit case 10 (microphone unit 1). That is, the elastic member 80 functions as a buffer between the microphone case 70 and the microphone unit 1.

Figure 6:
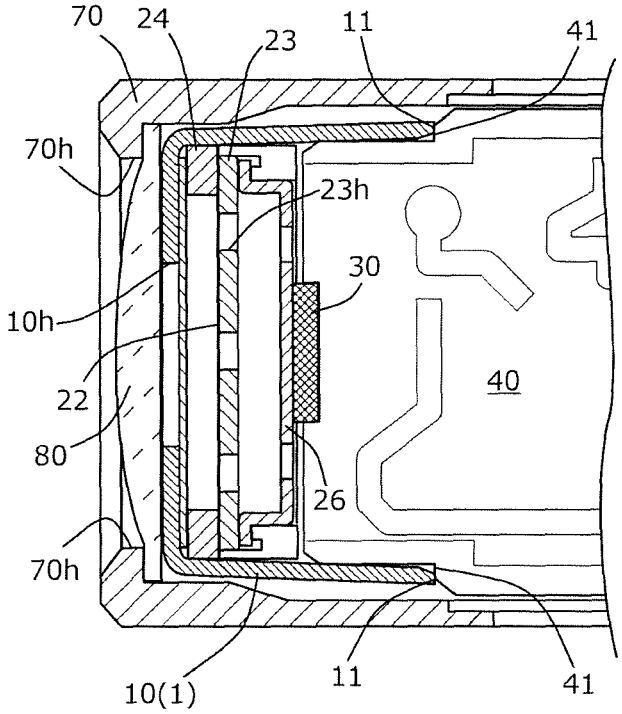
FIG. 6 is a cross-sectional side view illustrating components of the microphone.

FIG. 6 is a cross-sectional side view illustrating components of the microphone. The left side in FIG. 6 corresponds to the front of the microphone.

The microphone unit 1 is positioned inside the microphone case 70 with the open end 11 of the unit case 10 in contact with the receivers 41 of the audio-signal output circuit board 40. The microphone unit 1 inside the microphone case 70 receives the stress applied from the microphone case 70 along the rear direction and the stress applied from the audio-signal output circuit board 40 along the forward direction. Some of the stress applied from the microphone case 70 to the microphone unit 1 is absorbed by the elastic member 80. Some of the stress applied from the audio-signal output circuit board 40 to the microphone unit 1 is absorbed by the conductive elastic member 30. That is, the shape, the size, and the elastic modulus of the conductive elastic member 30 and the elastic member 80, for example, are set to values that prevent the microphone unit 1 from receiving excess stress.

Figure 7:
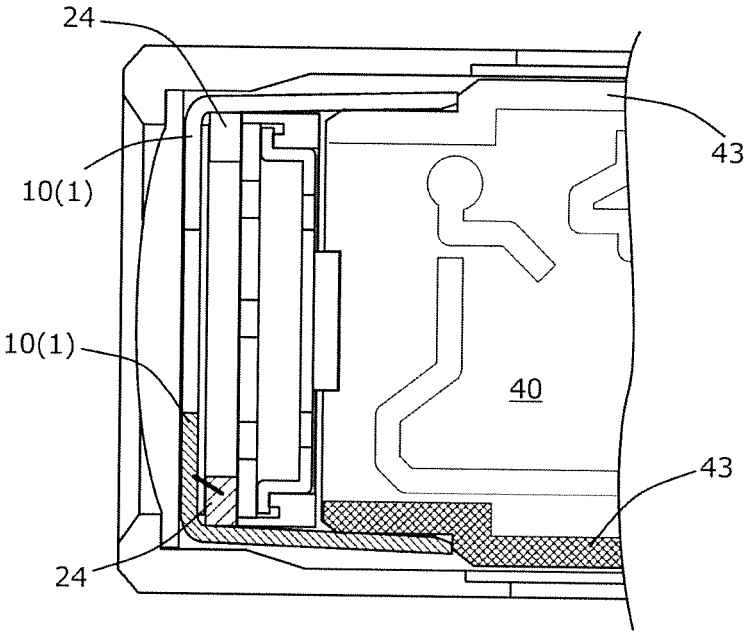
FIG. 7 is a cross-sectional side view illustrating a ground paths of the microphone.

FIG. 7 is a cross-sectional side view illustrating the ground paths of the microphone.

The diaphragm holder 24 is electrically connected to ground patterns 43 disposed on the audio-signal output circuit board 40 via the unit case 10. The straight line connecting the diaphragm holder 24 and the unit case 10 in FIG. 7 represents the electrically connected state between the diaphragm holder 24 and the unit case 10. This straight line is provided for convenience of explanation of the microphone according to the present invention.

The ground patterns 43 are metal films. The ground patterns 43 are disposed in a total of four positions, such as on the front and rear faces of the small-width section and a portion of the large-width section near the small-width section of the audio-signal output circuit board 40, and along the two opposite sides along the longitudinal direction (anteroposterior direction) of the audio-signal output circuit board 40. The ground patterns may be disposed on the side face of the audio-signal output circuit board 40. The ground pattern disposed on the side face (thickness part) and the ground patterns 43 disposed on the front and rear faces of the audio-signal output circuit board 40 may be connected to increase the contact area of the unit case 10 and the ground patterns such that the diaphragm holder 24 is certainly grounded.

The ground patters disposed on the audio-signal output circuit board 40 should be disposed on the portion of the audio-signal output circuit board 40 positioned inside the unit case 10, that is, the peripheral edge of the small-width section of the audio-signal output circuit board 40. The ground patterns should be disposed on at least one of the front and rear faces of the audio-signal output circuit board 40.

Figures 8A, 8B:
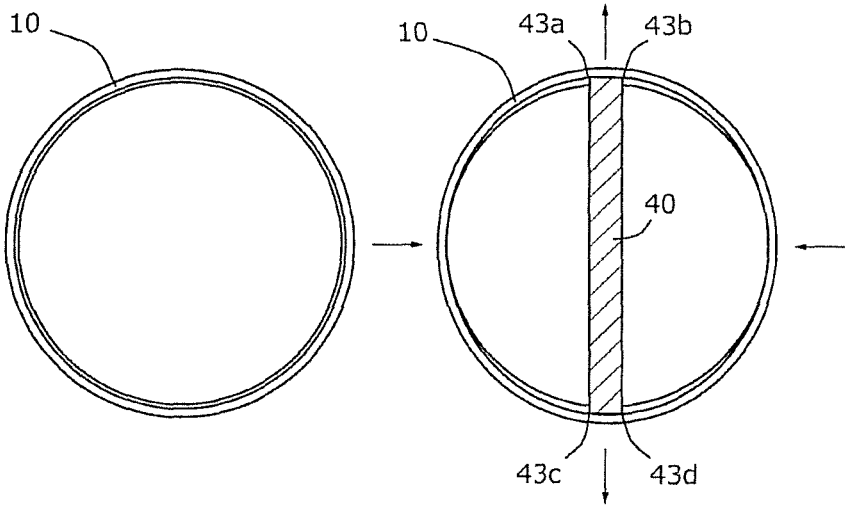
FIGS. 8A and 8B are cross-sectional front views of the unit case.
Figure 9:
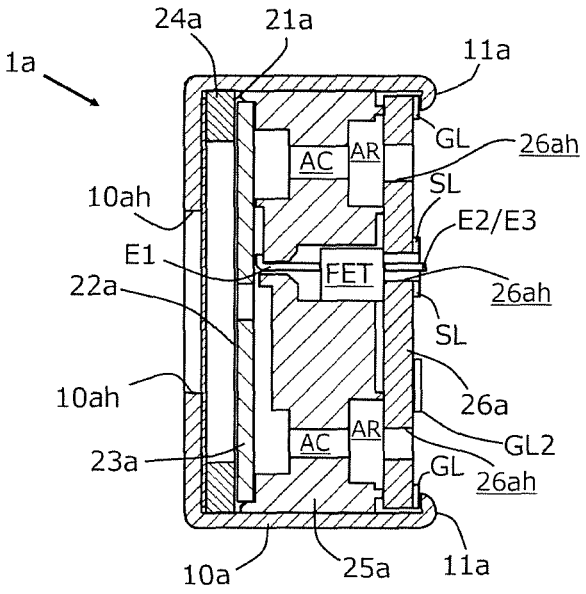
RELATED ART FIG. 9
FIG. 9 is a cross-sectional side view illustrating a microphone unit of a conventional microphone.

FIGS. 8A and 8B are cross-sectional front views of the unit case 10 (views in the direction from the front to the rear of the microphone). FIG. 8A illustrates the unit case 10 prior to insertion of the audio-signal output circuit board 40. FIG. 8B illustrates the unit case 10 after insertion of the audio-signal output circuit board 40. When the audio-signal output circuit board 40 is inserted into the unit case 10, then the unit case 10 expands at the location of the audio-signal output circuit board 40 (vertical direction in FIG. 8B) and contracts inward at locations opposing the front and rear faces of the audio-signal output circuit board 40 (horizontal direction in FIG. 8B). As a result, the relative eccentricity of the components installed in the unit case 10 is corrected. FIGS. 8A and 8B specifically illustrate a state in which the open end 11 of the unit case 10 expands to accommodate the audio-signal output circuit board 40.

The audio-signal output circuit board 40 is in contact with the inner circumferential surface of the unit case 10 at the ground patterns 43*a*, 43*b*, 43*c*, and 43*d* disposed at four positions on the audio-signal output circuit board 40. The ground patterns 43*a*, 43*b*, 43*c*, and 43*d* and the inner circumferential surface of the unit case 10 are in line contact. Thus, the electrical connection between the unit case 10 and the audio-signal output circuit board 40 is maintained even if the position of the audio-signal output circuit board 40 inside the unit case 10 shifts in the longitudinal direction due to stress applied to the audio-signal output circuit board 40 along the longitudinal direction.

According to the embodiment described above, the unit case 10 can be accommodated in the microphone case 70 with the open end 11 in contact with the receivers 41 of the audio-signal output circuit board 40. The unit case 10 and the ground patterns 43 of the audio-signal output circuit board 40 are in line contact. Thus, the electrical connection between the unit case 10 and the audio-signal output circuit board 40 is ensured.

The invention claimed is:

1. A microphone comprising:

a unit case having a shape of a hollow cylinder with a closed end, the unit case having an open end, the unit case accommodating an electroacoustic transducer;

an audio-signal output circuit board having a shape of a plate, the audio-signal output circuit board being connected to the electroacoustic transducer; and a microphone case accommodating the unit case and the audio-signal output circuit board, wherein the audio-signal output circuit board has a first portion disposed inside the unit case and a second portion disposed outside the unit case, the audio-signal output circuit board has at least one receiver disposed at a boundary area of the first portion and the second portion, and the open end of the unit case comes into contact with the at least one receiver when the unit case and the audio-signal output circuit board are accommodated in the microphone case.

2. The microphone according to claim 1, wherein the audio-signal output circuit board has at least one ground pattern electrically connected to the unit case, and the at least one ground pattern and the unit case are in contact with each other.

3. The microphone according to claim 2, wherein the at least one ground pattern is disposed on at least one of front and rear faces of the audio-signal output circuit board.

4. The microphone according to claim 3, wherein the at least one ground pattern is disposed on the peripheral edge of the first portion.

5. The microphone according to claim 4, wherein the at least one ground pattern is disposed on the first portion along at least one of two opposite sides of the audio-signal output circuit board.

6. The microphone according to claim 2, wherein the at least one ground pattern includes a plurality of ground patterns.

7. The microphone according to claim 1, wherein the first portion has a shape of a rectangle, and the at least one receiver is disposed on at least one of two opposite sides along the longitudinal direction of the first portion.

8. The microphone according to claim 1, wherein the first portion has a depression, the depression is disposed on a portion of the peripheral edge of the first portion, and the unit case and the audio-signal output circuit board are accommodated in the microphone case in an electrically connected state via a conductive elastic member placed in the depression.

9. The microphone according to claim 1, wherein the first portion has a length in the width direction orthogonal to the thickness direction of the audio-signal output circuit board, the second portion has a length in the width direction orthogonal to the thickness direction of the audio-signal output circuit board, the length of the first portion in the width direction orthogonal to the thickness direction of the audio-signal output circuit board is smaller than the length of the second portion in the width direction orthogonal to the thickness direction of the audio-signal output circuit board, and the first portion fits in the open end of the unit case when the unit case and the audio-signal output circuit board are accommodated in the microphone case.

10. The microphone according to claim 9, wherein the unit case expands in the width direction of the audio-signal output circuit board.

11. A microphone comprising:

a unit case having a shape of a hollow cylinder with a closed end, the unit case having an open end, the unit case accommodating an electroacoustic transducer;

an audio-signal output circuit board having a shape of a plate, the audio-signal output circuit board being connected to the electroacoustic transducer; and a microphone case accommodating the unit case and the audio-signal output circuit board, wherein the audio-signal output circuit board has at least one receiver disposed on a portion of the peripheral edge of the audio-signal output circuit board, the open end of the unit case comes into contact with the at least one receiver and is positioned when the unit case and the audio-signal output circuit board are accommodated in the microphone case the microphone case has a sound hole, the unit case faces the sound hole in the microphone case, and an elastic member is placed between the sound hole and the unit case.

* * * * *